US012186638B2

(12) United States Patent
Lai

(10) Patent No.: US 12,186,638 B2
(45) Date of Patent: Jan. 7, 2025

(54) GOLF BAG WITH RETRACTABLE HOOD

(71) Applicant: Wei Hung Lai, Taichung (TW)

(72) Inventor: Wei Hung Lai, Taichung (TW)

( * ) Notice: Subject to any disclaimer, the term of this patent is extended or adjusted under 35 U.S.C. 154(b) by 149 days.

(21) Appl. No.: 17/817,565

(22) Filed: Aug. 4, 2022

(65) Prior Publication Data

US 2024/0042290 A1 Feb. 8, 2024

(51) Int. Cl.
*A63B 55/00* (2015.01)

(52) U.S. Cl.
CPC ..... *A63B 55/404* (2015.10)

(58) Field of Classification Search
CPC ... A45C 2013/267; A45C 5/14; A45C 13/262; A45C 2013/265; A45C 13/04; A45C 13/38; A45C 13/385; A45C 13/28; A45C 2005/035; A45C 5/146; A45C 7/0027; A45C 7/0031; A45C 15/00; A45C 5/03; A45C 7/0072; A45C 9/00; A45C 13/001; A45C 13/02; A45C 2013/306; A45C 7/0045; B65G 11/18; B65G 61/00; B65G 2201/0211; B65G 49/062; B65G 57/302; B65G 59/063; A63B 55/404; A63B 55/30; A63B 55/40; A63B 2225/093; E05B 67/36; E05B 67/04; E05B 67/38; E05B 65/0089; E05B 70/32–34; E05B 70/58; E05B 70/63; Y10T 70/439; Y10T 70/443; Y10T 70/5009; Y10T 70/5031
USPC ..... 206/315.1, 315.3–315.8; 150/159, 154; 220/8

See application file for complete search history.

(56) References Cited

U.S. PATENT DOCUMENTS 3,901,299 A * 8/1975 Picco ..... A63B 55/00 206/315.4
4,078,594 A * 3/1978 Oeckl ..... A63B 55/00 280/DIG. 6
4,120,182 A * 10/1978 Michelman ..... E05B 65/0089 70/34
4,266,589 A * 5/1981 Cochran ..... A63B 55/50 206/315.3
4,459,832 A * 7/1984 Avrea ..... B60D 1/60 280/507

(Continued)

FOREIGN PATENT DOCUMENTS

CN 102357294 A * 2/2012 ..... A63B 55/00
CN 204864813 U * 12/2015

(Continued)

*Primary Examiner* — Chun Hoi Cheung
*Assistant Examiner* — Brijesh V. Patel
(74) *Attorney, Agent, or Firm* — Sinorica International

(57) ABSTRACT

A golf bag includes a bag, a hood, a guider and a lock device. The bag has a bag body and a frame, wherein the bag body is connected to the frame to hold a shape of the bag body. The hood has a lid to be opened and closed, wherein the hood is connected to a top of the bag to be moved between a first position and a second position. The lid is proximal to the bag when the hood is moved to the second position. The guider movably engages the hood with the bag to guide the hood to move between the first position and the second position. The lock device detachably connects the hood to the bag when the hood is moved to the first position to hold the hood at the first position, wherein the hood is free to move to the second position from the first position when the lock device disconnects the hood to the bag.

7 Claims, 8 Drawing Sheets

(56) References Cited

U.S. PATENT DOCUMENTS 4,630,717 A * 12/1986 Tong ..... A45C 7/0031 220/8
4,752,004 A * 6/1988 Very ..... A63B 55/406 150/159
4,836,565 A * 6/1989 Catalo ..... A63B 55/00 280/DIG. 6
4,932,523 A * 6/1990 Yamazoe ..... A63B 60/64 206/315.6
5,005,623 A * 4/1991 Webster, Jr. ..... A63B 55/406 150/159
5,010,746 A * 4/1991 Zane ..... E05B 67/063 70/39
5,131,442 A * 7/1992 Bevier ..... A63B 55/406 150/159
5,209,280 A * 5/1993 Gevas ..... A63B 55/406 150/159
5,220,950 A * 6/1993 Cordasco ..... A63B 55/406 150/159
5,344,202 A * 9/1994 Ramler ..... B65G 47/91 294/188
5,402,883 A * 4/1995 Shin ..... A63B 55/408 206/315.6
5,560,485 A * 10/1996 O'Hara, Jr. ..... E05B 73/0005 70/2
5,860,519 A * 1/1999 Meyer ..... A63B 55/30 206/315.6
5,875,658 A * 3/1999 Lahtinen ..... B63B 19/08 70/34
D409,384 S * 5/1999 Leftridge ..... D3/255
5,960,653 A * 10/1999 DeWalch ..... E05B 65/006 70/164
5,987,939 A * 11/1999 Pitisettakarn ..... E05B 67/36 70/38 R
6,029,813 A * 2/2000 Smolenski ..... A63B 55/406 206/315.4
6,062,412 A * 5/2000 Jacobsmeyer, Jr. ..... B65F 1/16 220/259.5
6,102,202 A * 8/2000 Jones ..... A63B 55/40 206/315.6
6,161,691 A * 12/2000 Ratcliff ..... A63B 55/40 206/315.6
6,234,312 B1 * 5/2001 Davis, Sr. ..... A63B 55/406 150/159
6,247,588 B1 * 6/2001 McCreary ..... A63B 55/404 150/159
6,378,581 B1 * 4/2002 Sheridan ..... A63B 55/406 150/159
6,442,982 B1 * 9/2002 Larsen ..... E05B 37/10 70/56
6,672,115 B2 * 1/2004 Wyers ..... B60D 1/52 70/381
6,834,879 B1 * 12/2004 Lorman ..... B60D 1/06 280/483
6,862,905 B2 * 3/2005 Zapushek ..... B62D 43/007 70/34
7,025,202 B2 * 4/2006 Jansen ..... A63B 55/404 70/64
7,059,158 B2 * 6/2006 Freeman ..... B60D 1/60 70/456 R
7,197,905 B2 * 4/2007 Ely ..... E05B 65/0089 70/164
7,213,424 B2 * 5/2007 Dewalch ..... E05B 67/365 70/164
7,568,718 B1 * 8/2009 Thomas ..... B60D 1/60 280/505
7,650,767 B2 * 1/2010 Robinson ..... G01R 11/04 70/164
7,694,808 B1 * 4/2010 Lin ..... A63B 55/00 70/64
7,930,913 B2 * 4/2011 Meyer ..... E05B 35/008 70/164
8,083,249 B2 * 12/2011 Most ..... B60D 1/065 70/237
8,157,089 B2 * 4/2012 Shiao ..... A63B 55/40 206/315.6
9,227,119 B2 * 1/2016 Jones ..... A63B 55/40
10,167,114 B2 * 1/2019 Casey ..... B65D 5/441
10,583,850 B1 * 3/2020 Pospicil ..... B62B 1/26
10,906,695 B2 * 2/2021 Hadar ..... B65D 21/086
2004/0232016 A1 * 11/2004 Dietrich ..... A63B 55/404 206/315.6
2005/0061691 A1 * 3/2005 Jansen ..... A63B 55/40 206/315.6
2006/0096682 A1 * 5/2006 Hsieh ..... A63B 55/00 150/159
2010/0269648 A1 * 10/2010 Fenstemaker ..... B25F 1/02 279/143
2011/0031143 A1 * 2/2011 Lindeman ..... A63B 55/00 206/457
2011/0247910 A1 * 10/2011 Darvish ..... A45C 13/385 190/18 A
2016/0096091 A1 * 4/2016 Hennenberg ..... A63B 55/404 206/315.3
2017/0036079 A1 * 2/2017 Lai ..... A63B 55/40
2021/0077873 A1 * 3/2021 Lai ..... A63B 55/40
2023/0276915 A1 * 9/2023 Tieu ..... A45C 7/0045 190/104

FOREIGN PATENT DOCUMENTS

FR 3033502 A1 * 9/2016 ..... A63B 55/00
JP S6224861 U * 7/1985 ..... A63B 55/00
WO WO-03000353 A2 * 1/2003 ..... A63B 55/00

* cited by examiner

GOLF BAG WITH RETRACTABLE HOOD

BACKGROUND OF THE INVENTION

1. Technical Field

The present invention relates to an accessory of golf club, and more particularly to a golf bag with a retractable hood.

2. Description of Related Art

Typically, a golf bag is used to store golf clubs that golfers may carry the golf bag to walk on the field. A conventional golf bag includes a bag body to receive golf clubs and a hood to cover the gold clubs in the bag body. Usually, the hood is releasably attached to the bag body. The hood is removeable when a golfer needs to pick a club in the bag body. Such design causes a risk that the hook may be lost when it is removed.

BRIEF SUMMARY OF THE INVENTION

In view of the above, the primary objective of the present invention is to provide a golf bag, which provides an easy way to pick a club in the bag without the risk of losing the hood.

In order to achieve the objective of the present invention, a golf bag includes a bag, a hood, a guider and a lock device. The bag has a bag body and a frame, wherein the bag body is connected to the frame to hold a shape of the bag body. The hood has a lid to be opened and closed, wherein the hood is connected to a top of the bag to be moved between a first position and a second position. The lid is proximal to the bag when the hood is moved to the second position. The guider movably engages the hood with the bag to guide the hood to move between the first position and the second position. The lock device detachably connects the hood to the bag when the hood is moved to the first position to hold the hood at the first position, wherein the hood is free to move to the second position from the first position when the lock device disconnects the hood to the bag.

In an embodiment, the frame includes a base fixed to a bottom of the bag body, a plurality of shafts having ends connected to the base, and a divider connected to opposite ends of the shafts, further wherein the shafts are received in the bag body.

In an embodiment, the guider has a ring member fixed to the hood and a plurality of tubes engaging the shafts to move on the shaft when the hood is moved.

In an embodiment, the tubes rest against the divider to prevent the hood from separating from the bag.

In an embodiment, a first ring is fixed to the bag body, and a second ring is fixed to the hood; the second ring rests against the first ring when the hood is moved to the second position.

In an embodiment, the lock device includes a pin and a pin base; the pin base is fixed to the frame, and the pin is detachably inserted into the pin base by passing through the bag body and the hood when the hood is moved to the first position.

In an embodiment, the pin has a pin section and a holding section; the holding section is left out of the bag body when the pin section is inserted into the pin base.

In an embodiment, a length of the pin section is greater than a diameter of the bag, so that a distal end of the pin section extends out of the bag when the pin section is inserted into the pin base.

In an embodiment, a lock through hole is provided on the pin section at a portion which extends out of the bag body, and a securing pin is detachably inserted into the lock through hole to prevent the pin from being pulled out unexpectedly.

In an embodiment, a first ring is fixed to a top of the bag body, and the pin passes through the first ring as well when the pin is inserted into the pin base.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
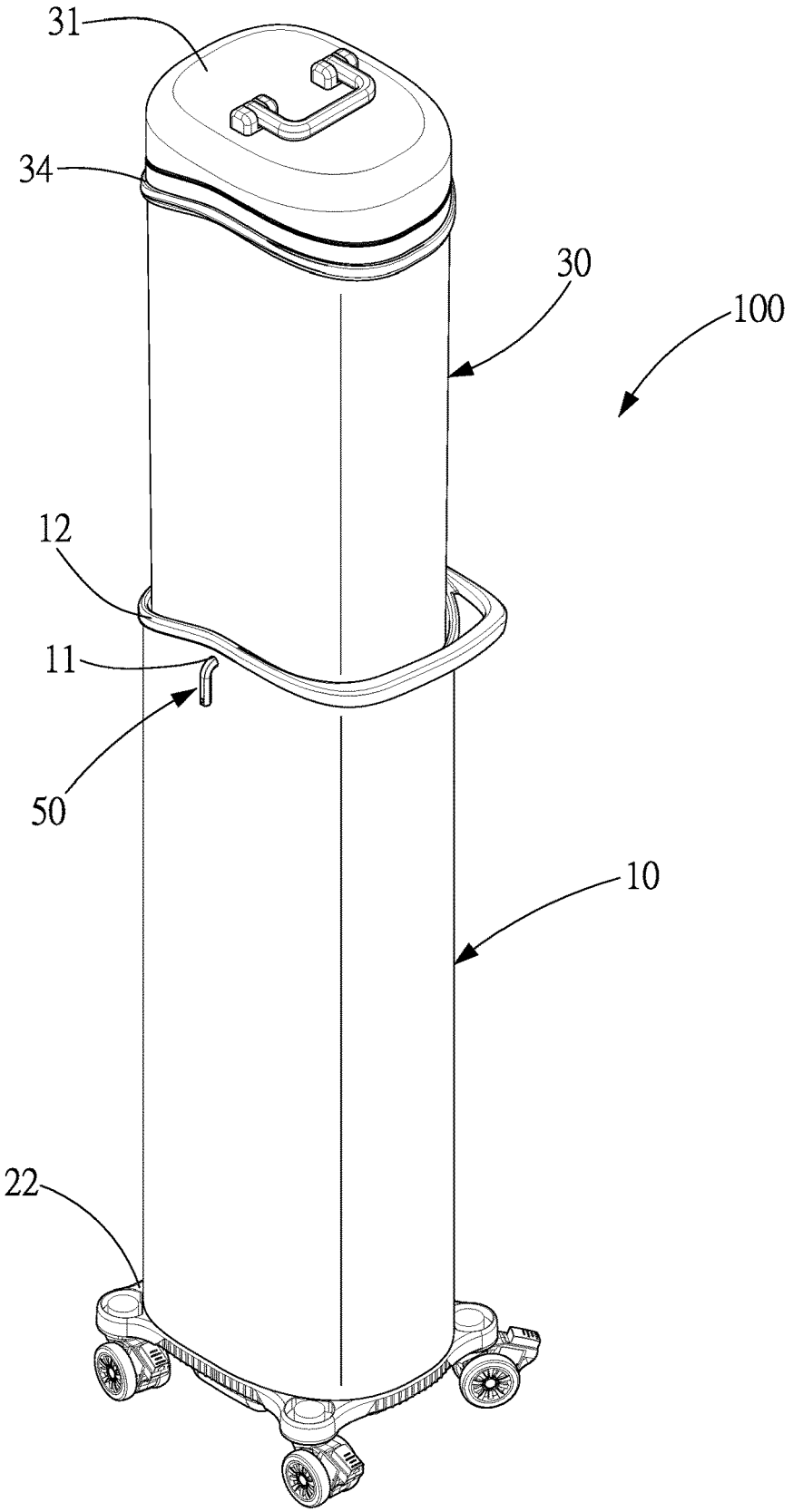
FIG. 1 is a perspective view of a preferred embodiment of the present invention, showing the hood in the first position.
Figure 2:
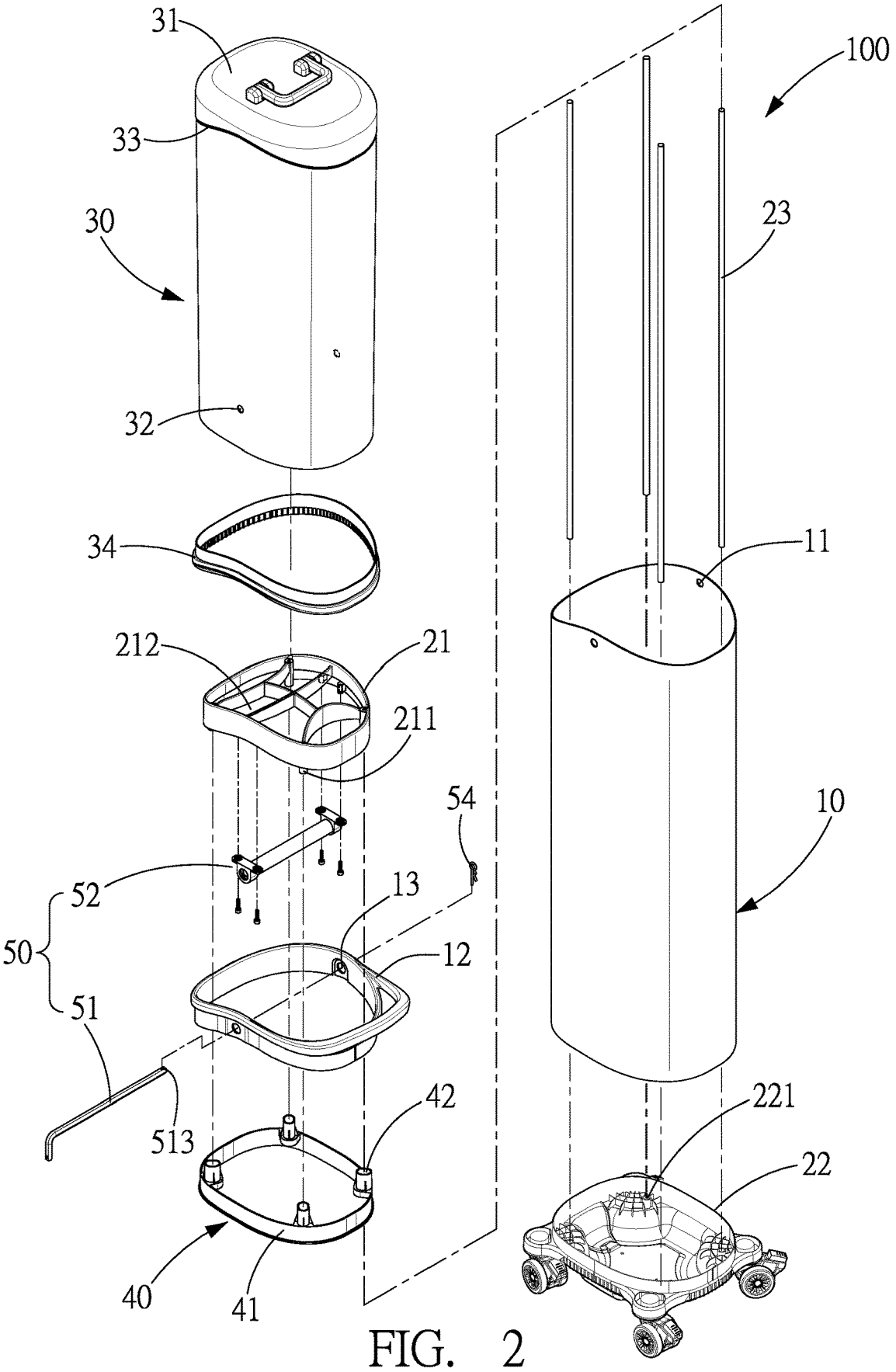
FIG. 2 is an exploded view of the preferred embodiment of the present invention.

As shown in FIGS. 1 to 8, a golf bag 100 of the preferred embodiment of the present invention includes a bag body 10, a frame 20, a hood 30, a guider 40, and a lock device 50.

Figure 3:
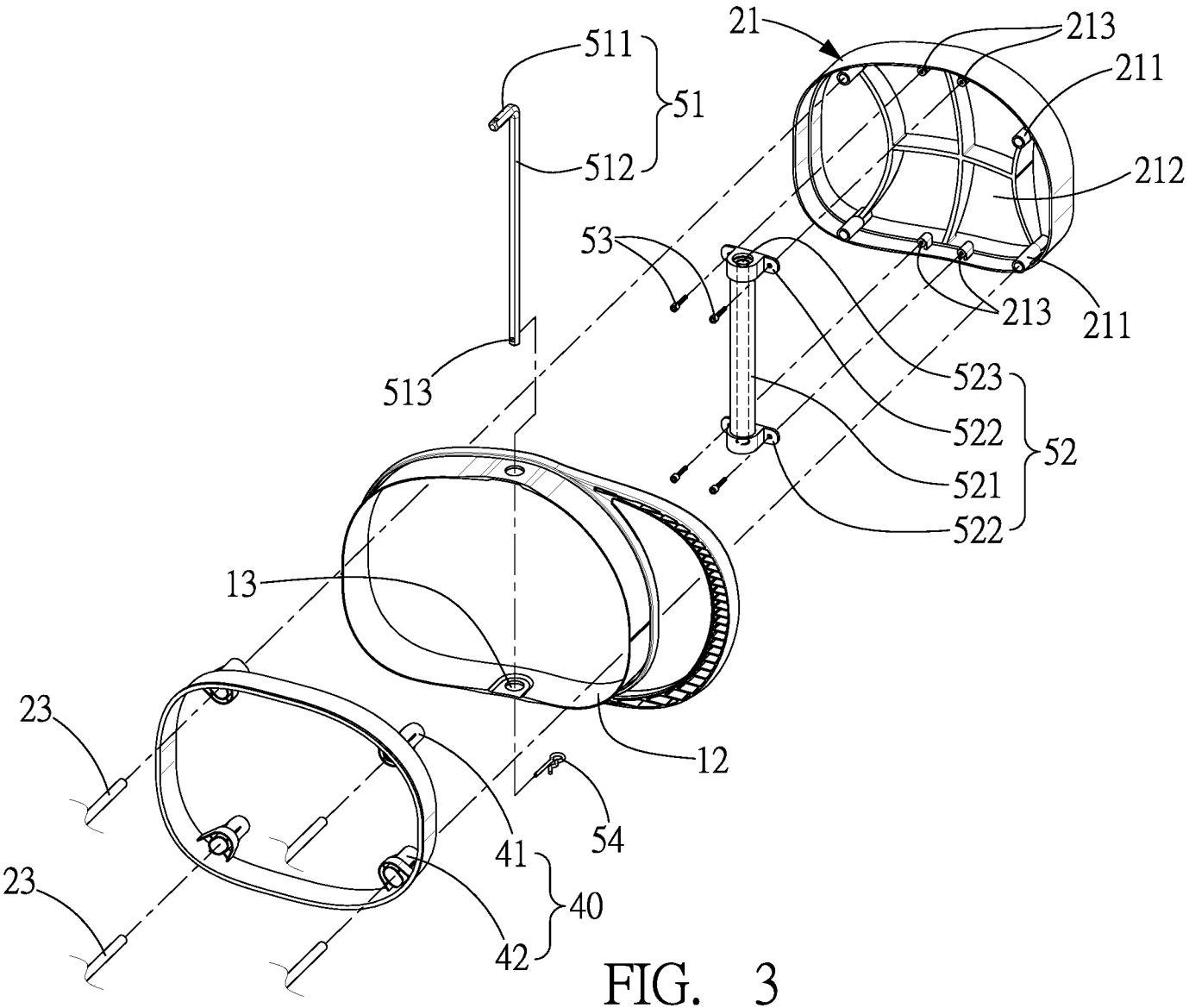
FIG. 3 is another exploded view of the preferred embodiment of the present invention.

The bag 1 includes a bag body 10 and a frame 20. The bag body 10 is a hollow barrel, having two first bores 11 aligned with each other. A first ring 12 is connected to a top of the bag body 10. The first ring 12 has two ring bores 13 corresponding to the first bores 11 respectively. The frame 20 is fixed to the bag body 10 to hold a shape thereof, having a divider 21, a base 22, and four shafts 23. The base 22 is fixed to a bottom of the bag body 10, the divider 21 is received in the bag body 10 just under the first ring 12, and the shafts 23 have opposite end connected to the base 22 and the divider 21. In details, the divider 21 is provided with four shaft holders 211 on a bottom side while the base 22 has four shaft holders 221 on a top side. The shafts 23 have the opposite ends engaging the shaft holders 211, 221 respectively. The divider 21 has a ring and several crossing plates to form isolated rooms 212 to receive golf clubs 70. The divider 21 further has two connecting portions 213 on an inner side (FIG. 3). An annular tunnel 60 is formed between the bag body 10 and the frame 20 since the divider 21 and the shafts 23 are kept a distance from the bag body 10.

The hood 30 is a hollow barrel, having a lid 31 on an end thereof and two second bores 32 therein, therefore the hood 30 has an open end opposite to the lid 31. The lid 31 is connected to the hood 30 via a zip 33, so that the lid 31 may be opened or be closed by operating the zip 33. A second ring 34 is fixed to the hood 30 just under the lid 31. The hood 30 is inserted into the tunnel 60 via the open end, so that the hood 30 is movable between a first position and a second position. In first position (FIGS. 1, 4 and 5), the hood 30 is moved away from the bag body 10 with the second bores 32 aligned with the first bores 11 and the ring bores 13. In second position (FIGS. 7 and 8), the hood 30 is moved toward the bag body 10 until the second ring 34 rests against the first ring 12 which ensures the hood 30 stopping at the second position.

The guider 40 is provided to guide the hood 30 moving between the first position and the second position. The guider 40 has a ring member 41 fixed to the open end of the hood 30 and four tubes 42 connected to the inner side of the ring member 41. The shafts 23 of the frame 20 pass through the tubes 42 respectively, so that the guider 40 is moved with the hood 30 to guide the movement of the hood 30 through the engagement of the shafts 23 and the tubes 42. Furthermore, the tubes 42 rest against the divider 21 to prevent the hood 30 from separating from the bag body 10.

The lock device 50 includes a pin 51 and a pin base 52. The pin base 52 has a pipe member 521 and two connectors 522 connected to the pipe member 521. The pin base 52 is connected to the divider 21 with the connectors 522 fixed to the connecting portions 213 of the divider 21. The pipe member 521 has a through hole 523 aligned with first bores 11 and the ring bores 13. The pin 51 is a L-shaped pin, having a holding section 511 and a pin section 512. The pin section 512 is able to be inserted into the through hole 523 of the pin base 52 through the first bores 11, the ring bores 13 and the second bores 32 with the holding section 511 being left out of the bag body 10 when the hood 30 is moved to the first position that may lock the hood 30 at the first position. In the present embodiment, a length of the pin section 512 is greater than a diameter of the bag body 10 (or a distance between the first bores 11). Therefore, the pin section 512 will pass through the bag body 10 when it is inserted into the pin base 52. A lock through hole 513 is provided on a distal section which is the portion of the pin section 512 left out of the bag body 10 when the pin section 512 is inserted into the pin base 52. A securing pin 54 is inserted into the lock through hole 513 to prevent the pin 51 from being pulled out unexpectedly.

Figure 4:
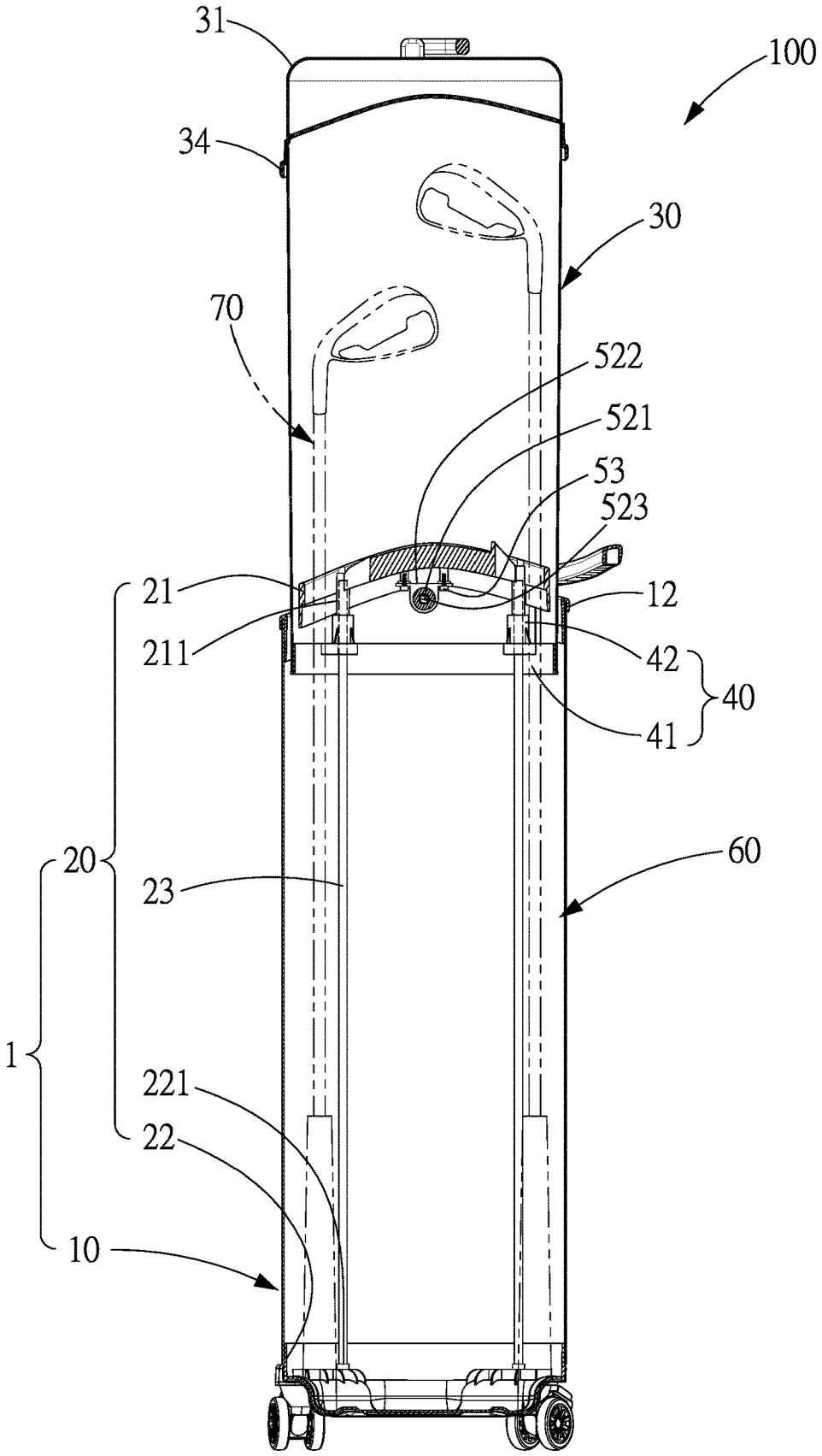
FIG. 4 is a sectional view of the preferred embodiment of the present invention.
Figure 5:
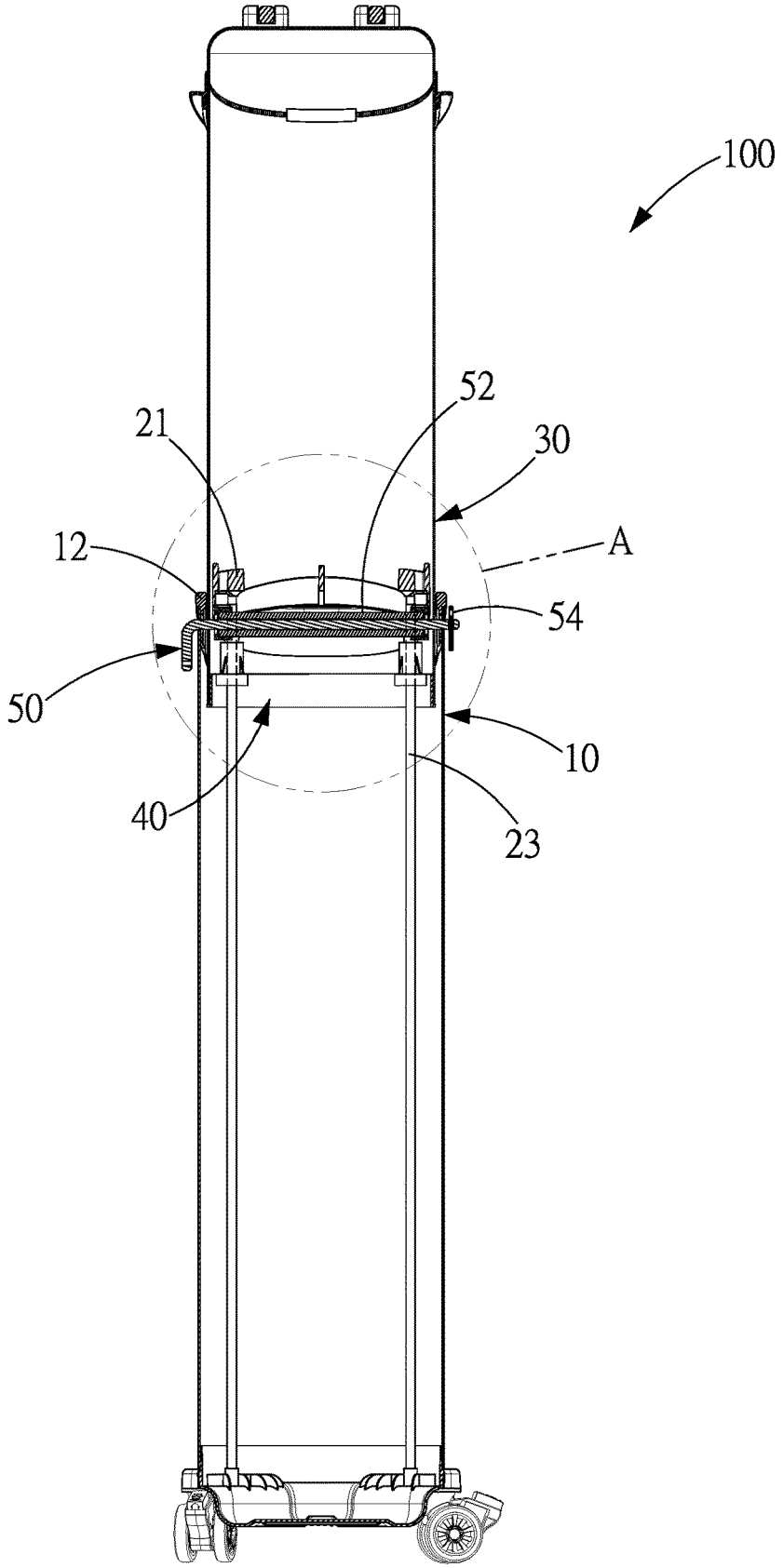
FIG. 5 is another sectional view of the preferred embodiment of the present invention.
Figure 6:
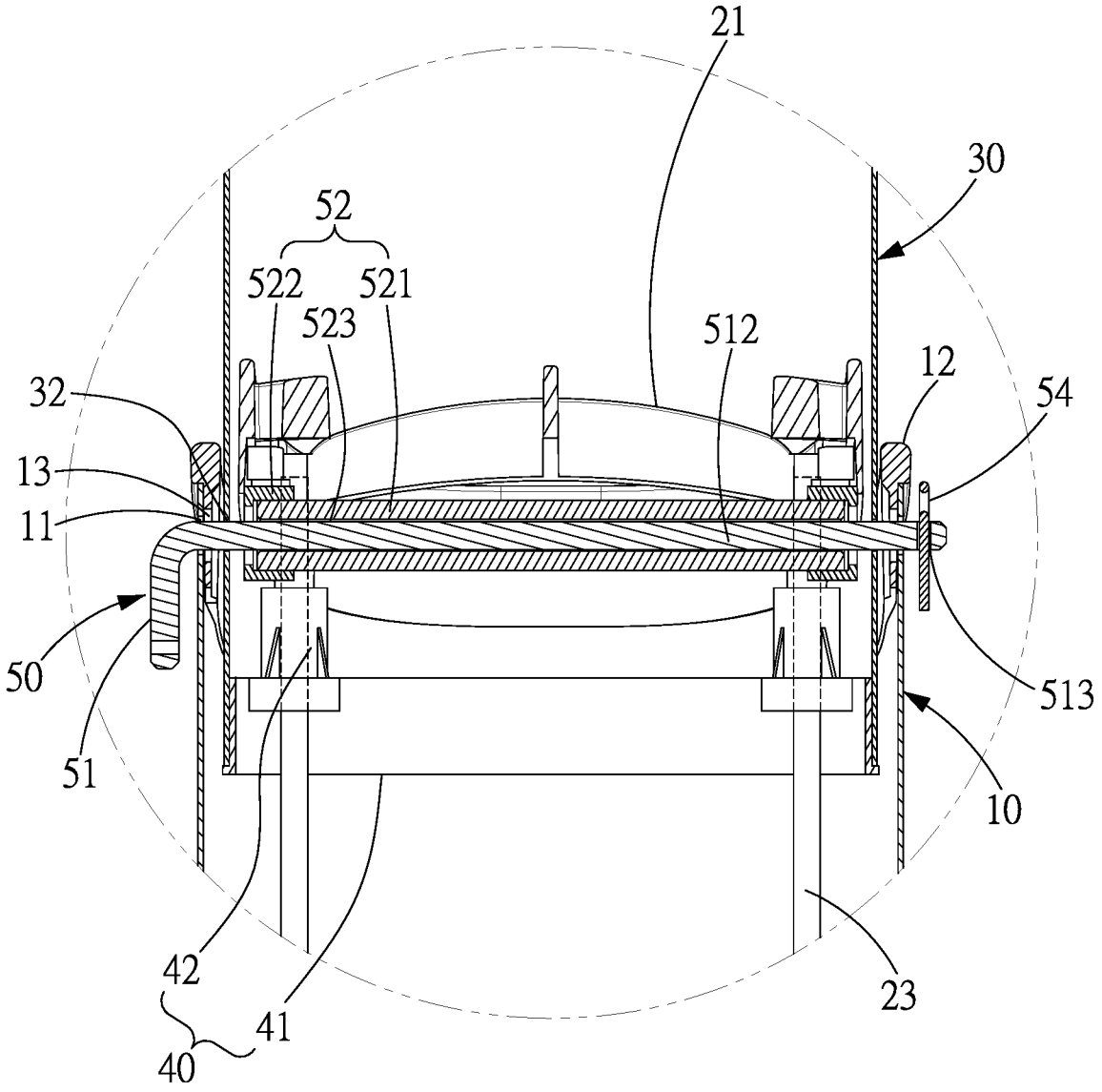
FIG. 6 is an enlarged view along the A portion of FIG. 5.
Figure 7:
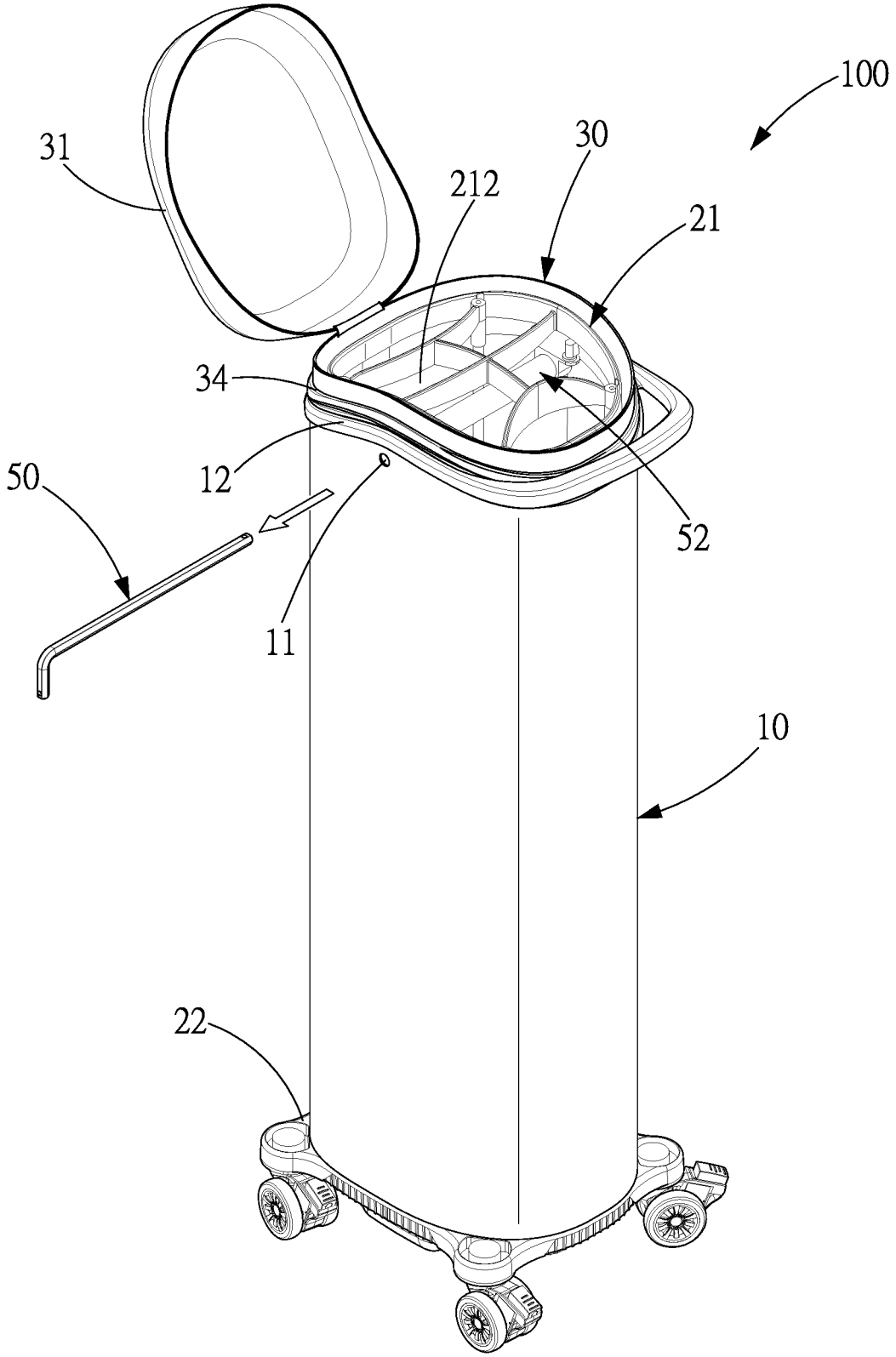
FIG. 7 is a perspective view of the preferred embodiment of the present invention, showing the hood in the second position.
Figure 8:
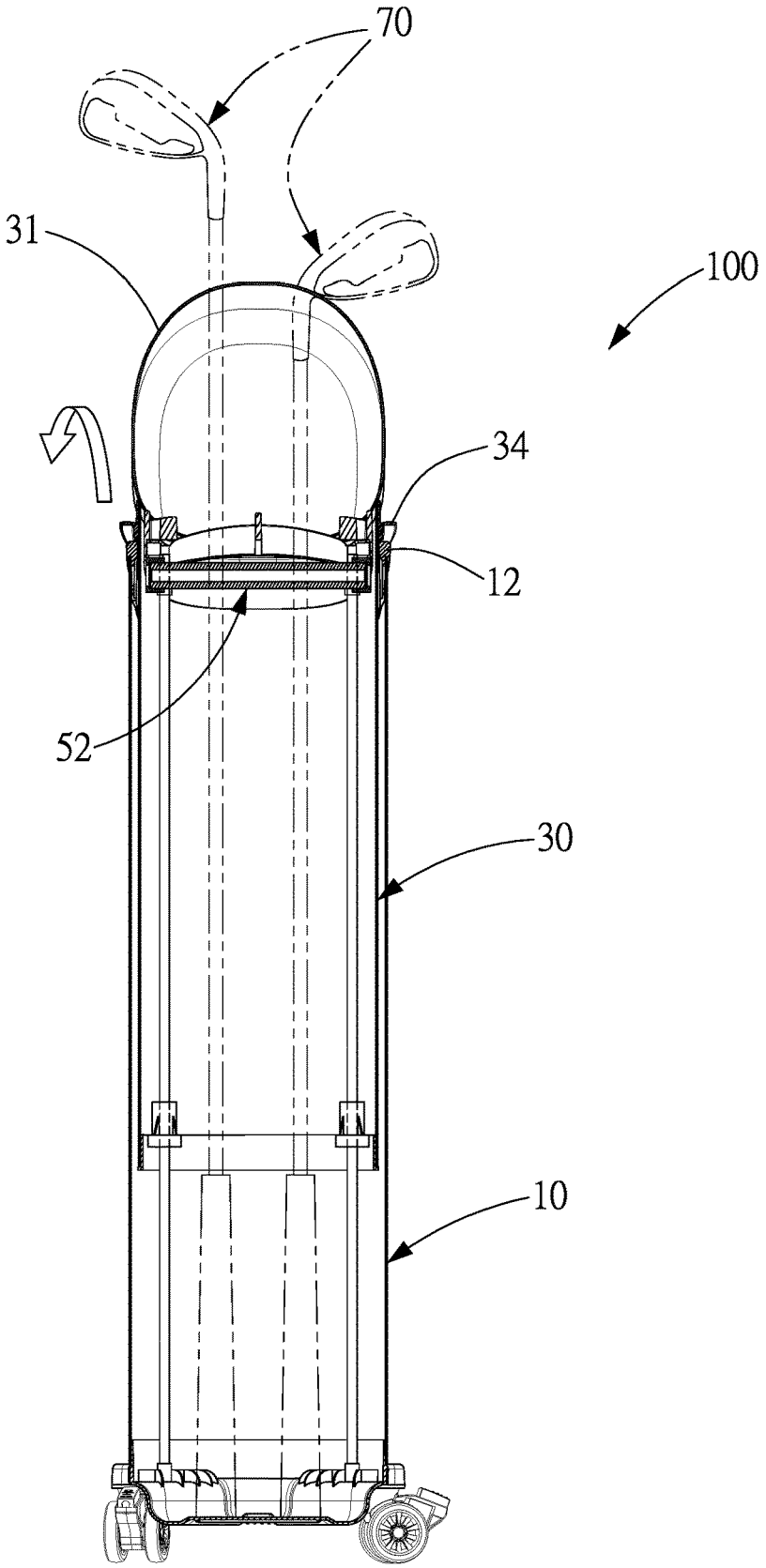
FIG. 8 is a sectional view of FIG. 7.

In conclusion, the hood 30 may be hold at the first position by inserting the pin 51 into the pin base 52 and inserting the securing pin 54 into the lock through hole 513 to secure the pin 51 (FIG. 4). When the securing pin 54 is removed and then the pin 51 is pulled out, the hood 30 is moved toward the second position because of gravity, and the golf clubs 70 will be exposed when the lid 31 is opened (FIG. 8). As a result, a golfer may pick any golf club easily and the hood 30 would never be lost.

It must be pointed out that the embodiments described above are only some preferred embodiments of the present invention. All equivalent structures which employ the concepts disclosed in this specification and the appended claims should fall within the scope of the present invention.

What is claimed is:

1. A golf bag, comprising:

a bag having a bag body and a frame, wherein the bag body is connected to the frame to hold a shape of the bag body;

a hood having a lid to be opened and closed, wherein the hood is connected to a top of the bag to be moved between a first position and a second position; the lid is distal to the bag when the hood is moved to the first position, and the lid is proximal to the bag when the hood is moved to the second position;

a guider movably engaging the hood with the bag to guide the hood to move between the first position and the second position; and a lock device detachably connecting the hood to the bag when the hood is moved to the first position to hold the hood at the first position, wherein the hood is free to move to the second position from the first position when the lock device disconnects the hood to the bag;

wherein the lock device includes a pin and a pin base; the pin base has a pipe member fixed to the frame, and the pin is detachably inserted into the pipe member of the pin base by passing through the bag body and the hood when the hood is moved to the first position;

wherein the frame includes a base fixed to a bottom of the bag body, shafts having ends connected to the base, and a divider connected to opposite ends of the shafts, further wherein the shafts are received in the bag body;

wherein a first ring is fixed to the bag body, and a second ring is fixed to the hood; the second ring rests against the first ring when the hood is moved to the second position; the first ring has two ring bores;

wherein the pin base is connected to the divider with the pipe member aligned with the two ring bores of the first ring, whereby the pin is detachably inserted into the pipe member of the pin base and the two ring bores of the first ring.

2. The golf bag of claim 1, wherein the guider has a ring member fixed to the hood and tubes engaging the shafts, the guider to move on the shaft when the hood is moved.

3. The golf bag of claim 2, wherein the tubes rest against the divider to prevent the hood from separating from the bag.

4. The golf bag of claim 1, wherein the pin has a pin section and a holding section; the holding section is left out of the bag body when the pin section is inserted into the pin base.

5. The golf bag of claim 4, wherein a length of the pin section is greater than a diameter of the bag, so that a distal end of the pin section extends out of the bag when the pin section is inserted into the pin base.

6. The golf bag of claim 3, wherein a lock through hole is provided on the pin section at a portion which extends out of the bag body, and a securing pin is detachably inserted into the lock through hole to prevent the pin from being pulled out unexpectedly.

7. The golf bag of claim 1, wherein the first ring is fixed to a top of the bag body, and the pin passes through the first ring as well when the pin is inserted into the pin base.

* * * * *